9/29/87 XR 4,697,189

United States Patent [19]

Ness

[11] Patent Number: 4,697,189

[45] Date of Patent: Sep. 29, 1987

[54] MICROSTRIP ANTENNA

[75] Inventor: John B. Ness, Pullenvale, Australia

[73] Assignees: University of Queensland; Commonwealth of Australia, both of Queensland, Australia

[21] Appl. No.: 855,488

[22] Filed: Apr. 24, 1986

[30] Foreign Application Priority Data

Apr. 26, 1985 [AU] Australia ..... PH0328

[51] Int. Cl.[4] ..... H01Q 1/38; H01Q 1/42

[52] U.S. Cl. ..... 343/700 MS; 343/872

[58] Field of Search ..... 343/700 MS, 872

[56] References Cited

U.S. PATENT DOCUMENTS 4,151,532 4/1979 Kaloi ..... 343/700 MS
4,475,108 10/1984 Moser ..... 343/700 MS
4,477,813 10/1984 Weiss ..... 343/700 MS

FOREIGN PATENT DOCUMENTS 2130018 5/1984 United Kingdom ..... 343/700 MS

*Primary Examiner*—Robert E. Wise
*Assistant Examiner*—Doris J. Johnson
*Attorney, Agent, or Firm*—Schwartz, Jeffery, Schwaab, Mack, Blumenthal & Evans

[57] ABSTRACT

A microwave antenna formed with a conductive patch supported over and facing a ground plate beneath a support sheet overlapping the ground plate and spaced therefrom. An electrical lead to the patch is passed up through the ground plate to a hole through the patch and support sheet through which a solder joint is formed.

5 Claims, 3 Drawing Figures

MICROSTRIP ANTENNA

FIELD OF THE INVENTION

This invention relates to an antenna for microwaves.

PRIOR ART

Microstrip antennas are used in microwave communication links. One problem with conventional examples of such antennas is that they require the provision of a radome or cover to protect the antenna from the environment, particularly when exposed to harsh weather conditions such as are found in the Australian outback. U.S. application Ser. No. 699309, filed Feb. 7,1985, Ness, describes one type of microstrip antenna.

At present the radomes or covers are formed from fibreglass or plastics. They add to the cost of the antennas and may also detune resonant microstrip antennas.

OBJECTS OF THE INVENTION

It is an object of the present invention to provide an antenna comprising an alternate form of mechanical protection for the antenna.

It is a further preferred object to provide an antenna which has a significant gain in signal strength over conventional microstrip antennas.

Other preferred objects of the present invention will become apparent from the following description.

OUTLINE OF THE INVENTION

In a broad aspect the present invention resides in an antenna for microwaves including:

a ground plate;

a substantially planar support means spaced from the ground plate to provide an air gap therebetween;

a metal patch on the support means; and electrical conductor means connected to the metal patch and ground plate, wherein:

the metal patch is provided on a face of the support means directed towards the ground plate, the support means overlaps the ground plate and is connected to, or engages, the ground plate at the periphery thereof.

The ground plate may comprise a disc with an upturned peripheral or circumferential rim or flange.

Preferably the support means is formed of fibreglass, PVC polycarbonate or other suitable material in the form of a disc, square or other geometrical shape. The support means may be provided with a peripheral or circumferential rim or flange which engages the outer face of the rim or flange on the ground plate.

Preferably the metal patch is formed substantially centrally of the inwardly directed face of the support means and is separated from the ground plate by the air gap.

The distance between the metal patch and ground plate may be varied, to vary the air gap and thereby tune the antenna. Indicator marks e.g. on the rim of the ground plate, may be provided to indicate the air gap.

For a circularly polarized antenna, a layer of dielectric material e.g. of teflon, fibreglass, or other suitable material may be placed on the ground plate so that the effective dielectric constant of the air gap and dielectric material is in the range of 1.2 to 1.4, more preferably approximately 1.3.

BRIEF DESCRIPTION OF THE DRAWINGS

To enable the invention to be fully understood, preferred embodiments will now be described with reference to the accompanying drawings in which.

DESCRIPTION OF PREFERRED EMBODIMENTS

Figure 1:
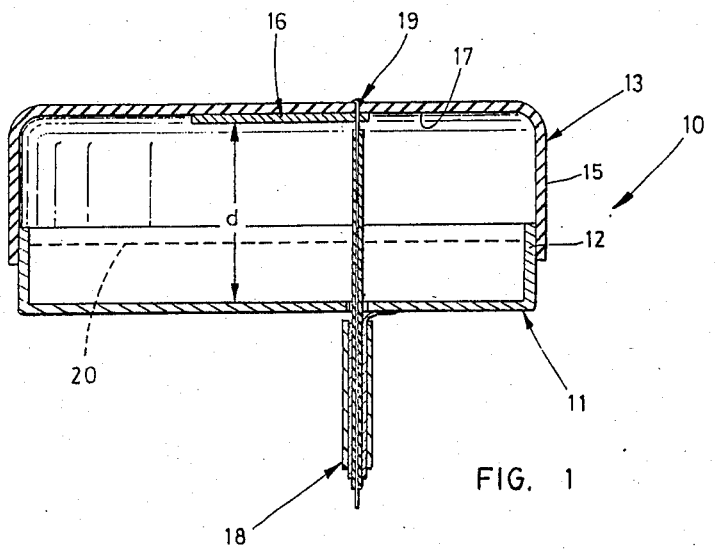
FIG. 1 is a cross section through a first embodiment of an inverted microstrip antenna.

In FIG. 1, the antenna 10 has a ground plate 11 (of suitable metal) with a circumferential rim 12.

The support means 13 is formed of e.g. epoxy fibreglass as used in circuit boards and has a central metal patch 16, with a circumferential rim 15 which engages over the rim 12 on the ground plate 11.

The metal patch 16 may be provided as a disc centrally in the inner face of the support means 13.

A feeder line 18, in the form of a co-axial cable, is connected to the ground plate 11 and the metal patch 16. A plated-through hole 19 is provided in patch 16 and support means 13 to facilitate construction.

As will be readily apparent to the skilled addressee, the support means 13 provides mechanical protection for the antenna without the requirement for a separate radome.

By adjusting the position of the support means 13 relative to the ground plate 11, the air gap d can be varied to tune the antenna and this adjustment can be aided by indicator marks on the rim 12 of the ground plate read against the lower edge of the rim 15 on the support means.

Comparison tests of the antenna of the present invention with known antennas have produced gains in signal strength of 8.5 dB compared with 6 dB for a conventional microstrip antenna. Even though the material of the support means 13 can be lossy compared with the dielectric materials used for the covers of known antennas, the gain is significant.

For circularly polarized antennas, wide scan widths e.g. out to 80°–85° with good axial ratio, can be obtained by placing a layer of dielectric material 20 (shown in dashed lines) on the ground plate so that the effective dielectric constant of the air gap and the dielectric material is in the range of 1.2 to 1.4, with best results being obtained when the constant is approximately 1.3.

To tune the antenna for a wide range of frequencies, the size of the metal patch 16 can be varied as for a standard microstrip antenna. Further tuning is possible with this antenna by varying the distance d to the ground plane.

For multipatch arrays, individual metal patches can be tuned and the mutual coupling between them can be varied by suitable, dielectric or metal loading at appropriate positions in the air space d.

Figure 2:
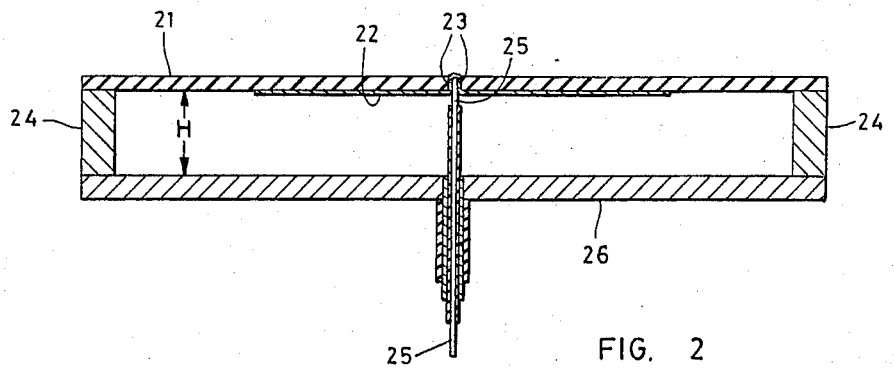
FIG. 2 is a cross section through a second embodiment of an inverted microstrip antenna.

FIG. 2 shows, in a more basic form, the features of an inverted patch antenna according to the present invention. These are as follows:

The radiating element 22 can be etched on circuit board 21 in any shape as is required.

Circuit board 21 is suspended above the ground plane 26 by a spacer 24. Spacer 24 may be metal or dielectric.

The resonant frequency is determined principally by the size of patch 22, its shape and height (H), and, to a lesser extent, by the material type and thickness of the circuit board 21.

Plating through hole 23 allows easy connection of the feed 25.

Compared to a conventional microstrip antenna this design has the following advantages:

1. The height H is not restricted to a fixed circuit board thickness.
2. The antenna gain is higher and the bandwidth is wider than that of a conventional patch antenna.
3. The height H can be adjusted to fine tune the resonant frequency.
4. Circuit board 21 can be standard epoxy board rather than the expensive microwave substrate material used in conventional designs.
5. The circuit board 21 now acts as a radome so no additional cover (which often causes detuning) is necessary.
6. The effect of the circuit board 21 on the frequency is small. Therefore the performance of the antenna is not critically dependent on the properties of the circuit board as is the case for a conventional design. This design is much more tolerant of variations in the board properties. For higher frequencies, a thinner circuit board can be used.
7. Since epoxy board can be used, plated through holes for soldering feed connections are easily incorporated.
8. The height H can be varied to suit gain/bandwidth trade offs.

Additional Features (i) Dielectric board or other dielectric material can be introduced into the air gap spacing to vary the effective dielectric constant of the patch. This can be done, to optimise the radiation pattern characteristics as in a circularly polarised design.

(ii) The dielectric board can also be introduced to adjust the resonant frequency.

(iii) Tuning screws can also easily be incorporated as will be clear to those skilled in the art.

(iv) In a multi patch array, dielectric or metallic posts or other like bodies can easily be inserted between the elements to vary mutual coupling and affect the radiation pattern.

Figure 3:
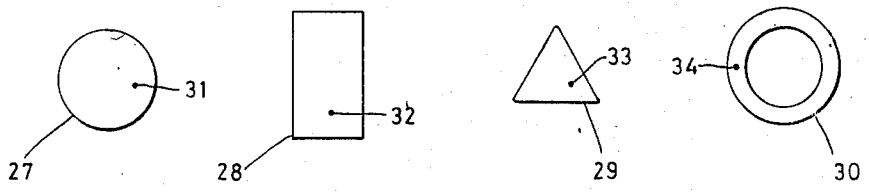
FIG. 3 shows a variety of geometrics which may be adopted for the metal patches of the antenna.

FIG. 3 shows a variety of shapes 27 to 30 that might be used in forming the metal patch and the points at which a feed wire may be connected are indicated (points 31 to 34).

In the assembly of FIG. 2, a peripheral ring with a C-shape cross section, with the parallel flanges directly inwardly, may be used to hold the assembly together. A ring of resilient material might be slipped over the rim of the assembly, so as to hold the top and bottom plates against the spacer. The height of the spacer determines the gap H and different spacers may be used to tune the antenna.

The embodiments described are by way of illustrative example only, and various changes and modifications can be made thereto without departing from the present invention.

I claim:

1. A microwave antenna including:

a ground plate;

a substanially planar support means spaced from the ground plate to provide an air gap therebetween;

a metal patch on the support means, said metal patch being provided on a face of the support means which is directed towards the ground plate;

an electrical conductor means connected to the metal patch and ground plate; and the support means and the ground plate being provided with complementary peripheral flanges which are adjustably slidably engaged together to hold the support means over the ground plate at a selected spacing therefrom, with the variation of the spacing effecting adjustment of the thickness of the air gap.

2. A microwave antenna as claimed in claim 1, wherein a layer of dielectric material is inserted into the air gap.

3. A microwave antenna as claimed in claim 2, wherein the effective dielectric constant of the air gap and the dielectric material is in the range of 1.2 to 1.4.

4. A microwave antenna as claimed in claim 1, wherein said support means and ground plate have a generally circular geometry and are generally coaxial with and metal patch disposed coaxially.

5. A microwave antenna as claimed in claim 4, wherein the metal patch is also circular.

* * * * *